US008925751B2

(12) United States Patent
Benz

(10) Patent No.: US 8,925,751 B2
(45) Date of Patent: Jan. 6, 2015

(54) DOOR STORAGE CONTAINER FOR A REFRIGERATION DEVICE

(75) Inventor: Thomas Benz, Haar (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1188 days.

(21) Appl. No.: 11/919,260

(22) PCT Filed: Apr. 20, 2006

(86) PCT No.: PCT/EP2006/061690

§ 371 (c)(1),
(2), (4) Date: Oct. 24, 2007

(87) PCT Pub. No.: WO2006/120111

PCT Pub. Date: Nov. 16, 2006

(65) Prior Publication Data

US 2010/0139168 A1 Jun. 10, 2010

(30) Foreign Application Priority Data

May 11, 2005 (DE) ..... 10 2005 022 516

(51) Int. Cl.

| | |
|---|---|
| ***B65D 25/24*** | (2006.01) |
| ***B65D 6/24*** | (2006.01) |
| ***F25D 23/04*** | (2006.01) |
| *B65D 6/04* | (2006.01) |

(52) U.S. Cl.

CPC ..... *F25D 23/04* (2013.01)
USPC ..... 220/4.32; 220/618; 220/621; 220/662; 220/665

(58) Field of Classification Search

USPC ..... 220/1.5, 4.32, 617, 685, 4.33, 665, 621, 220/618, 604, 691, 4.21

See application file for complete search history.

(56) References Cited

U.S. PATENT DOCUMENTS

| | | | | |
|---|---|---|---|---|
| 3,854,269 | A * | 12/1974 | Hancock | 220/683 |
| 3,955,702 | A * | 5/1976 | Lundy | 220/4.28 |
| 4,002,261 | A * | 1/1977 | Litchfield | 220/683 |
| 4,120,551 | A * | 10/1978 | Godtschalck | 312/348.1 |
| 5,204,149 | A * | 4/1993 | Phenicie et al. | 428/57 |
| RE34,377 | E * | 9/1993 | Wilkins et al. | 312/245 |
| 5,332,611 | A | 7/1994 | Shanok et al. | |
| 5,638,973 | A * | 6/1997 | Dewey et al. | 220/4.33 |
| 5,797,514 | A * | 8/1998 | Twiggar et al. | 220/683 |
| 6,832,580 | B2 * | 12/2004 | Marchioro | 119/452 |
| 7,228,612 | B2 * | 6/2007 | Lyvers | 29/527.1 |

FOREIGN PATENT DOCUMENTS

| | | | |
|---|---|---|---|
| CN | 1153282 | A | 7/1997 |
| CN | 2531412 | Y | 1/2003 |
| CN | 2589911 | Y | 12/2003 |

(Continued)

OTHER PUBLICATIONS

International Search Report PCT/EP2006/061690.

*Primary Examiner* — Mickey Yu
*Assistant Examiner* — Niki Eloshway
(74) *Attorney, Agent, or Firm* — Nixon & Vanderhye P.C.

(57) ABSTRACT

The invention relates to a door storage container having a base, a rear wall, and a front wall. The front wall is in the form of a plurality of interlocking elements assembled together. The plurality of interlocking elements assembled together to form the front wall includes an upper extrusion profile, a lower extrusion profile, and a panel enclosed between the upper extrusion profile and the lower extrusion profile.

25 Claims, 2 Drawing Sheets

(56) References Cited

FOREIGN PATENT DOCUMENTS

Figure 1:
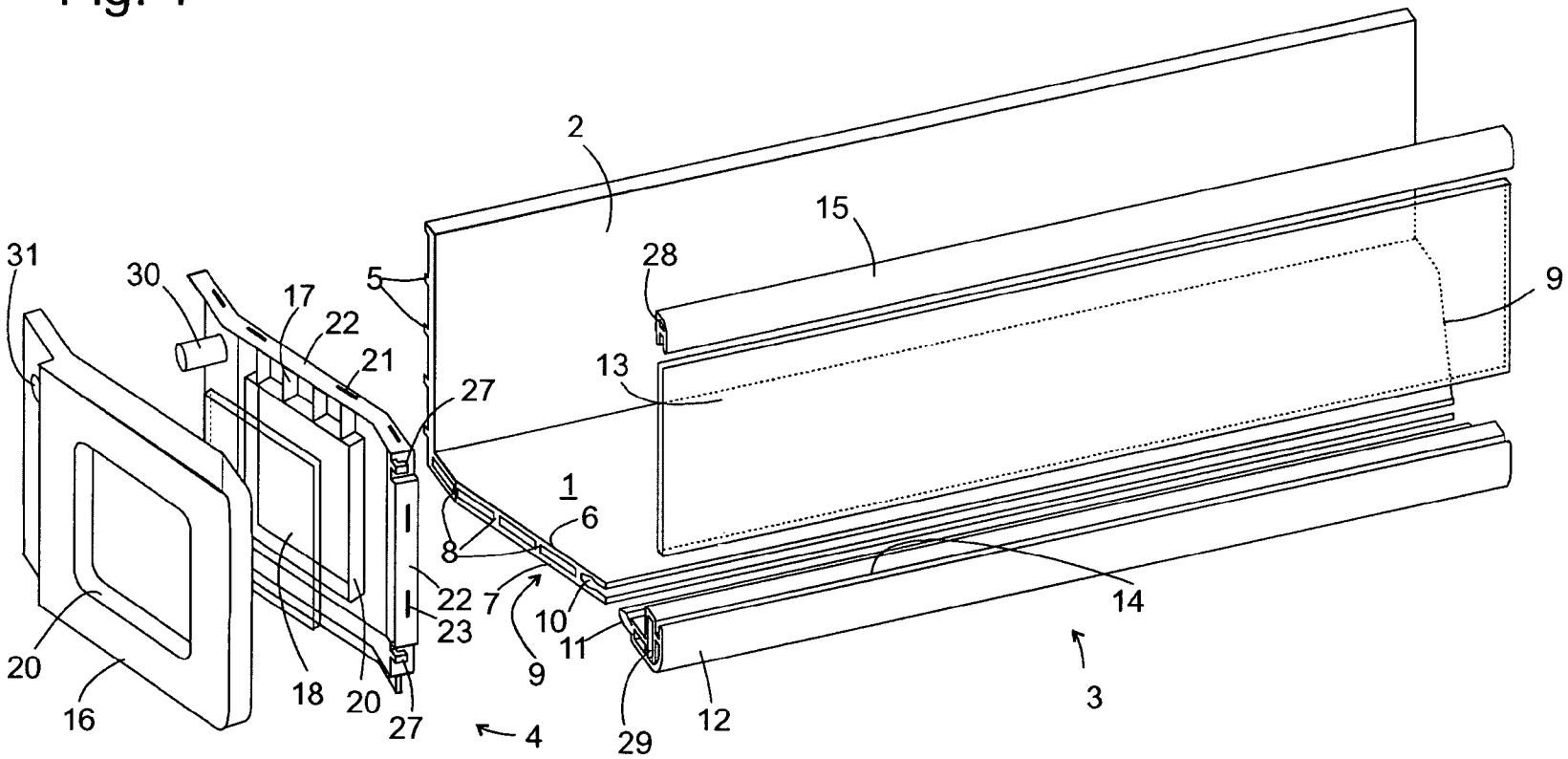

| | | |
|---|---|---|
| DE | 198 30 325 | 1/2000 |
| DE | 101 17 763 | 10/2002 |
| DE | 102 08 063 | 9/2003 |
| EP | 1 338 219 | 8/2003 |
| JP | 8-226751 | 9/1996 |
| JP | 2000-65458 | 3/2000 |

* cited by examiner

DOOR STORAGE CONTAINER FOR A REFRIGERATION DEVICE

The present invention relates to a door storage container for a refrigeration device. Door storage containers of this type are frequently boxes manufactured as a single piece from plastic using an injection molding process. They are required in various dimensions and designs for the manufacture of different models of refrigeration devices. The single-piece manufacture makes specific molding tools necessary for each individual model of door storage container. Efforts are therefore being focused on reducing the number of tools required for producing different door storage container models.

DE 102 08 063 A1 discloses a door-mounted storage container having a multipart design wherein a front wall of the door storage container is formed from an extruded section. This allows a uniform type of profile to be used, from which front walls for door storage containers of different length can be cut to size. In order to implement different embodiments of door storage containers which are required for example to give a brand-specific stamp in each case to devices marketed under different labels, a specific extrusion profile is required in each case as well as a separate tool for producing said profile.

The object of the invention is to create a door storage container which enables a variety of different appearances to be realized with a small number of different parts.

The object is achieved in that in the case of a door storage container comprising a base, a front wall and a rear wall, the front wall, which most influences the appearance perceived by the user, is assembled from a plurality of interlocking elements. Said elements can be combined in different ways from one series of models to another and thus result in a multiplicity of possible embodiments.

The front wall is preferably assembled from an upper and a lower extrusion profile and a panel enclosed between said extrusion profiles. This permits e.g. standard panels, e.g. made of glass or transparent plastic, to be combined with different, brand-specific extrusion profiles, or identical extrusion profiles to be combined with panels made from different materials or with different surface decors on a brand-independent basis.

In order to simplify the assembly of the door storage container, the extrusion profiles of the front wall are preferably hollow sections in the cavities of which studs projecting from end walls of the door storage container engage.

In order to transfer the characteristic stamp of the front wall obtained by the combination of the panel and the hollow sections to the end walls, the latter are preferably each provided with a window in which a panel made from the same material as the panel of the front wall is framed.

Toward that end the end wall is beneficially assembled from an outer frame and an inner frame which between them enclose the edges of the panel.

Base and rear wall of the door storage container are preferably formed from an extrusion profile, and moreover preferably as a single piece from a common extrusion profile.

In order to achieve a high degree of stability together with low weight, the extrusion profile can be embodied as a hollow section. The base preferably comprises an upper and a lower panel which are joined to form a single piece by means of a plurality of webs.

In order to improve the cohesion between base and front wall of the door storage container, in the case of a slot-and-key connection between the base and the front wall the key is preferably provided with a thickened head and the slot with an undercut into which the head latches.

Figure 2:
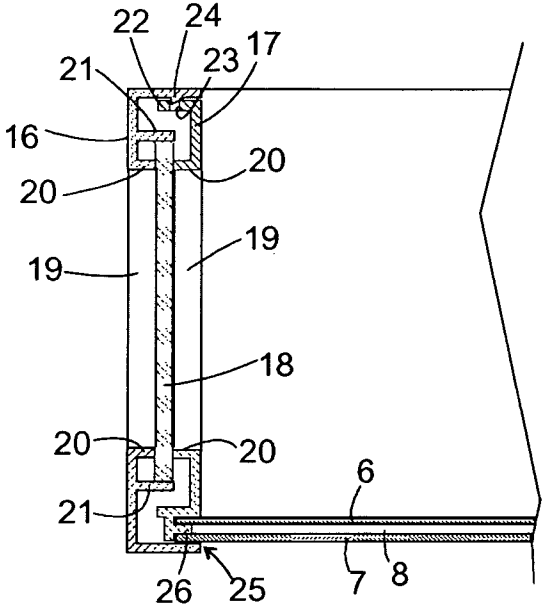

Further features and advantages of the invention will emerge from the following description of exemplary embodiments with reference to the attached figures, in which:

FIG. 1 shows an expanded perspective view of a door storage container according to the invention; and FIG. 2 shows a section through an end wall of the door storage container from FIG. 1.

The door storage container shown in FIG. 1 has a base 1, a rear wall 2, which, in the installed state of the door storage container in a refrigeration device, bears against the inside of the door of said refrigeration device, a front wall 3 and two end walls 4 which are embodied as mirror images of each other and only one of which is shown in FIG. 1.

Base 1 and rear wall 2 are manufactured in a single piece from a plastic extrusion profile. On the outside of the rear wall 2, invisible for a user in the installed state, are a plurality of flat ribs 5 intended to stiffen the rear wall 2. The base 1 has a two-layer structure comprising an upper panel 6 and a lower panel 7 which are connected to one another by means of a plurality of vertical webs 8 in order to lend the base 1 a high degree of flexural rigidity despite the small amount of material used.

The end edges 9 of the base panel converge with increasing distance from the rear wall 2, such that the door storage container can extend over the entire free width of the inside of the door of a refrigeration device in which it is installed without impeding the opening and closing of the door.

At a front edge of the base 1 the panels 6, 7 delimit an undercut slot 10 which is provided for the purpose of accommodating a key 11 of a lower extrusion profile 12 of the front wall 3. The key 11 has a concealed head which is broader than the entrance of the slot 10, with the result that the panels 6, 7 have to be elastically pressed apart in order to introduce the key into the slot 10. The positive-locking anchoring of the extrusion profile 12 to the base 1 achieved in this way additionally contributes to the stability of the base 1 and prevents slot and key becoming detached from each other as a result of an uncontrolled deflection of the extrusion profile 12.

A glass panel 13 is provided for the purpose of being inserted into an upwardly open slot 14 of the lower extrusion profile 12. An upper extrusion profile 15 is clipped onto the top edge of the glass panel 13.

The end walls 4 are each assembled from an outer frame 16 which forms the outside of the edge wall, an inner frame 17 facing the interior of the door storage container, and a glass panel 18 enclosed between the frames 16, 17. As can be seen in the section shown in FIG. 2, each of the frames 16, 17 has a vertical base panel with a window recess 19 and webs 20, 21 which run around the window recess 19 and between them secure the glass panel 18. Formed on a web 22 of the inner frame running around the outside of the base panel are slits 23 into which, as can be seen in FIG. 2, catches 24 of the outer frame 16 engage. At a bottom edge of the end wall 4 the frames 16, 17 delimit a slot 25 into which the base 1 engages. Narrow studs 26 of the inner frame 16 jut out into the slot 25 and engage in the cavities between the panels 6, 7 and webs 8 of the base 1.

As can be seen in FIG. 1, hooks 27 are formed at a front edge of the inner frame 17, said hooks 27 engaging in the assembled state into cavities 28, 29 of the extrusion profiles 12 and 15 and in this way ensuring the cohesion of the front wall 3.

A suspension stud 30 of the inner frame 17 projects in the installed state through an aperture 31 of the outer frame 16 toward the outside and serves to attach the door storage container to the door of a refrigeration device.

The invention claimed is:

1. A door storage container comprising: a generally L-shaped profile forming a rear wall and a base extending laterally away from a lower portion of the rear wall, the base being formed with two parallelly extending panels separated by a plurality of webs; and a front wall removably coupled with the base, the front wall being in the form of a plurality of interlocking elements assembled together, wherein the plurality of interlocking elements assembled together to form the front wall includes an upper extrusion profile, a lower extrusion profile, and a panel enclosed between the upper extrusion profile and the lower extrusion profile, and wherein a pair of end walls is mounted to the front wall at respective ends thereof and each of the upper extrusion profile and the lower extrusion profile of the front wall has a hollow section forming a cavity and each of the end walls includes projecting elements each of which is received in a respective cavity formed by a hollow section of the upper extrusion profile and the lower extrusion profile of the front wall.

2. The door storage container as claimed in claim 1, wherein the plurality of interlocking elements assembled together to form the front wall includes a front wall panel that is supported between the upper extrusion profile and the lower extrusion profile of the front wall and each of the end walls has a panel formed of the same material as the front wall panel.

3. The door storage container as claimed in claim 2, wherein each end wall is formed of an outer frame and an inner frame and the respective panel of each end wall is disposed between the outer frame and the inner frame of the end wall.

4. The door storage container as claimed in claim 1, wherein the L-shaped profile of the base and the rear wall has a hollow section.

5. The door storage container as claimed in claim 1, wherein at least one of the end walls is formed from a first frame and a second frame and an end panel mounted between the first frame and the second frame, with the end wall mounted to the L-shaped profile.

6. The door storage container as claimed in claim 5 and further comprising a first web formed on the first frame and a second web formed on the second frame in opposition to the first web with the end panel held between the first web and the second web.

7. The door storage container as claimed in claim 6 wherein the first frame is formed with a panel recess having the first web formed therein and the second frame is formed with a panel recess with the second web formed therein.

8. The door storage container as claimed in claim 7 wherein the first frame includes a first panel opening having the first web extending therearound and the second frame includes a second panel opening with the second web extending therearound.

9. The door storage container as claimed in claim 8 and further comprising a third web formed on one of the first frame and the second frame for supporting a side edge of the panel.

10. The door storage container as claimed in claim 1, wherein at least one of the end walls is mounted to the L-shaped profile, the end wall being formed with a stud projecting away therefrom and into a recess intermediate the two base panels.

11. A refrigeration device, comprising:

a door; and the door storage container of claim 1, wherein the door storage container is installed on the door.

12. A door storage container for a refrigerator comprising:

a generally L-shaped profile forming a rear wall and a base extending laterally away from a lower portion of the rear wall, the rear wall being configured to bear against an inside surface of a door of a refrigerator; and a front wall removably coupled with the base to oppose the rear wall, the front wall including a lower extrusion profile, an upper extrusion profile and a front wall panel connected to the lower extrusion profile, the front wall panel being enclosed between the upper extrusion profile and the lower extrusion profile, wherein a pair of end walls is mounted to the front wall at respective ends thereof and each end of the upper extrusion profile and the lower extrusion profile of the front wall has a hollow section forming a cavity and each end wall includes projecting elements which are received in a respective cavity of the upper extrusion profile and the lower extrusion profile of the front wall.

13. The door storage container as claimed in claim 12, wherein each end wall has a panel formed of a same material as the front wall panel.

14. The door storage container as claimed in claim 13, wherein each end wall is formed of an outer frame and an inner frame and the respective panel of each end wall is disposed between the outer frame and the inner frame of the end wall.

15. The door storage container as claimed in claim 12, wherein at least one of the end walls is formed from a first frame and a second frame and an end panel mounted between the first frame and the second frame, the end wall being mounted to the L-shaped profile.

16. A refrigeration device, comprising:

a door; and the door storage container of claim 12, wherein the door storage container is installed on the door.

17. A door storage container comprising: a generally L-shaped profile forming a rear wall and a base extending laterally away from a lower portion of the rear wall, the base being formed with two parallelly extending panels separated by a plurality of webs; and a front wall removably coupled with the base, the front wall being in the form of a plurality of interlocking elements assembled together, wherein the base and the front wall are joined to one another by a slot formed in the base with the slot having an interior portion adjacent an entrance to the slot with the entrance being narrower than the interior portion, and a head larger than the entrance is formed on the front wall and configured for form fitting receipt in the interior.

18. The door storage container as claimed in claim 17, wherein the plurality of interlocking elements assembled together to form the front wall includes an upper extrusion profile, a lower extrusion profile, and a panel enclosed between the upper extrusion profile and the lower extrusion profile.

19. The door storage container as claimed in claim 18 and further comprising a pair of end walls each mounted to the front wall at a respective end thereof and each of the upper extrusion profile and the lower extrusion profile of the front wall has a hollow section forming a cavity and each of the end walls includes projecting elements each of which is received in a respective cavity formed by a hollow section of the upper extrusion profile and the lower extrusion profile of the front wall.

20. The door storage container as claimed in claim 19, wherein the plurality of interlocking elements assembled together to form the front wall includes a front wall panel that is supported between the upper extrusion profile and the lower extrusion profile of the front wall and each of the end walls has a panel formed of the same material as the front wall panel.

21. A door storage container for a refrigerator comprising:

a generally L-shaped profile forming a rear wall and a base extending laterally away from a lower portion of the rear wall, the rear wall being configured to bear against an inside surface of a door of a refrigerator; and a front wall removably coupled with the base to oppose the rear wall, the front wall including a lower extrusion profile and a front wall panel connected to the lower extrusion profile, wherein the base and the front wall are joined to one another by a slot formed in the base with the slot having an interior portion adjacent an entrance to the slot with the entrance being narrower than the interior portion, and a head larger than the entrance is formed on the front wall and configured for form fitting receipt in the interior.

22. The door storage container as claimed in claim 21, said front wall further comprising an upper extrusion profile, the front wall panel being enclosed between the upper extrusion profile and the lower extrusion profile.

23. The door storage container as claimed in claim 22, further comprising a pair of end walls, each end wall being mounted to the front wall at a respective end thereof, each end of the upper extrusion profile and the lower extrusion profile of the front wall has a hollow section forming a cavity and each end wall includes projecting elements which are received in a respective cavity of the upper extrusion profile and the lower extrusion profile of the front wall.

24. The door storage container as claimed in claim 23, wherein each end wall has a panel formed of a same material as the front wall panel.

25. The door storage container as claimed in claim 24, wherein each end wall is formed of an outer frame and an inner frame and the respective panel of each end wall is disposed between the outer frame and the inner frame of the end wall.

* * * * *